US006346889B1

(12) United States Patent
Moss

(10) Patent No.: US 6,346,889 B1
(45) Date of Patent: Feb. 12, 2002

(54) SECURITY SYSTEM FOR AUTOMATIC DOOR

(76) Inventor: Richard D. Moss, 9481 Sierra Dr., Arvada, CO (US) 80005

( * ) Notice: Subject to any disclaimer, the term of this patent is extended or adjusted under 35 U.S.C. 154(b) by 0 days.

(21) Appl. No.: 09/610,013

(22) Filed: Jul. 1, 2000

(51) Int. Cl.[7] ..... G08B 21/00

(52) U.S. Cl. ..... 340/686.1; 340/545.1; 340/825.31; 340/825.49; 49/14

(58) Field of Search ..... 340/686.1, 815.45, 340/545.1, 825.69, 825.31; 49/14; 318/280, 484, 468, 626, 446

(56) References Cited

U.S. PATENT DOCUMENTS

| | | | | | |
|---|---|---|---|---|---|
| 4,035,702 | A | | 7/1977 | Pettersen et al. | 318/285 |
| 4,433,274 | A | | 2/1984 | Duhame | 318/283 |
| 4,463,292 | A | | 7/1984 | Engelmann | 318/283 |
| 4,464,651 | A | | 8/1984 | Duhame | 340/521 |
| 4,922,166 | A | | 5/1990 | Ichida et al. | 313/414 |
| 5,226,257 | A | | 7/1993 | Moss | 49/13 |
| 5,247,232 | A | * | 9/1993 | Lin | 318/468 |
| 5,278,480 | A | * | 1/1994 | Murray | 318/626 |
| 5,357,183 | A | * | 10/1994 | Lin | 318/468 |
| 5,510,686 | A | * | 4/1996 | Collier | 318/446 |
| 5,576,701 | A | * | 11/1996 | Heitschel et al. | 340/825.31 |
| 5,781,107 | A | * | 7/1998 | Ji | 340/545 |
| 6,046,562 | A | * | 7/1998 | Emil | 318/484 |
| 5,798,681 | A | * | 8/1998 | Chang | 340/815.45 |
| 5,841,253 | A | * | 11/1998 | Fitzgibbon et al. | 318/280 |
| 6,166,634 | A | * | 12/1998 | Dean | 340/545.1 |
| 5,903,226 | A | * | 5/1999 | Suman et al. | 340/825.69 |
| 6,070,361 | A | * | 6/2000 | Paterno | 49/14 |

* cited by examiner

*Primary Examiner*—Daniel J. Wu
*Assistant Examiner*—Phung T. Nguyen
(74) *Attorney, Agent, or Firm*—Rader, Fishman & Grauer PLLC; Lee G. Meyer

(57) ABSTRACT

A system and device for insuring the integrity of an automatic garage door has a sensor to determine the status of the door with respect to a predetermined position and a programable actuator which provides a positive signal for automatically activating a warning or alert system when the door is in predetermined position when the programmable actuator is activated and the sensor indicates that the door is at other than the predetermined position. Preferably the programmable actuator is a timer and the predetermined position is closed. The timer can be remotely programmable. The actuator can also be triggered by a sensor of an event such as darkness. Remote means are provided for manually activating the door to return to the desired position by an RF frequency transmitter.

29 Claims, 5 Drawing Sheets

SECURITY SYSTEM FOR AUTOMATIC DOOR

BACKGROUND

1. Field of the Invention

The invention relates to security systems for use with an automated garage door; and, more particularly to a garage door security apparatus and method for remotely determining a predetermined position of the garage door and providing selective deactivation of the automated garage door system to prevent its operation.

2. Description of Related Art

Automated doors, including automated security doors and, specifically, automated garage doors, are familiar and convenient. These types of doors utilize a motorized mechanism which automatically opens and/or closes the door. The mechanism can be actuated either remotely by means of a radio receiver system or conventionally by means of a switch. Overhead garage doors typically roll on tracks, reversibly, from a closed vertical position to an open, overhead, horizontal position. They also have the ability to be left ajar in various positions to allow ingress and egress of pets, children, and the like.

Occasionally, these automated doors are left ajar or open, whether intentionally or accidently. In hot weather, automatic doors may be purposely left ajar to facilitate cooling of a building's interior. Children also are prone to opening these doors without closing them. These situations are especially problematic with garage doors because an open garage door not only subjects the contents of the garage to theft but, in many homes or buildings, the garage also permits unrestricted access to the interior of the house or building. A door left even only slightly ajar represents a breach of security, since an intruder merely can crawl through the opening. Further, automated doors equipped with radio frequency activated openers occasionally are subject to activation by stray signals. Many TV remote controls and other wireless controls can activate an automated system and inadvertently open an automated door.

These possible breaches of security have been recognized as a problem, and the prior art is replete with garage door security apparatuses of various types, as illustrated and disclosed in U.S. Pat. Nos. 4,464,651 and 4,433,274. U.S. Pat. No. 4,922,166 sets forth a door safety system. There also have been several proposals for closing open garage doors, such as the apparatuses and systems disclosed in U.S. Pat. Nos. 4,035,702; 4,463,292; and 5,510,686. However, there are several disadvantages present in the prior art, one of which is that the door can start to close without warning. Thus, if one wanted to leave the door open during the day, they would have to deactivate the automated closing system and then remember to reactivate the system at a later time. Another problem associated with these systems is that they only function when the door is in its full open position. If the door is left ajar for ventilation during the summer, these systems cannot automatically close the door. Thus, if an owner forgets to close the door at the end of the day, the door would remain open all night. This would provide an intruder the opportunity to slip under the door and either take items from the garage and any unlocked car parked inside or, worse still, gain entry to the house or building attached to the garage.

My prior patent, U.S. Pat. No. 5,226,257, addressed these issues, but the apparatus disclosed in that patent only had the capacity to signal that the door was in other than a fully closed position. Additionally, the device of the earlier patent required a hard wired system. A control panel inside the house had a first switch, to effect selective actuation of a garage door opener motor, and a second on/off switch arranged to effect selective locking engagement and disengagement of the system. An indicator light was arranged to indicate the separation of a garage door from a garage door framework, and an abutment switch was arranged for engagement with a vehicular windshield for actuation of the garage door motor.

There continues to be a need for an improved garage door security apparatus which provides convenience, ease of use, and effectiveness in a manner that has not been satisfactorily addressed by the prior art. It therefore would be advantageous to have a programmable system capable of remotely signaling that the door is not in a predetermined position, no matter the degree to which the door is opened, or, in the alternative, capable of remotely indicating that the door is closed when it should be either open or ajar.

SUMMARY OF THE INVENTION

An improved, programmable security device has now been discovered that senses the condition or status of an automated door and remotely transmits a signal when the door is sensed to be out of a predetermined position, which then allows the operator to move the door to the desired position.

In a broad aspect, the security system of the instant invention comprises an automated door having a sensor device for determining the door's position in communication with a signal generating device for generating a signal and a programable warning device for indicating that the door is in other than a predetermined position. The automated door has a means for automatically opening and/or closing the door that is commercially available. The warning device may be programmed to indicate, for example, when the door is in a position other than in a predetermined position or, alternatively, when the door is in the predetermined position, such that a warning signal is produced when the door is in a position other than a desired position, as appropriate.

In an exemplary embodiment, a single unit coupled to the door comprises both the sensor device and the signal generating device. In such embodiments, the sensor device transmits signals to the remotely located warning device by means of radio frequency (RF) or by any other wireless means for transmitting signals as made available by technological advances in wireless systems and as practiced by those skilled in the relevant art. In this manner the warning device need not be hard wired to the sensor, allowing broad application in the retrofit market. In a further embodiment, the warning device is a visual indicator, such as, for example, an indicator light which is illuminated when the door is out of position, such as when the door is in other than in a closed position. Alternatively, the indicator light may flash intermittently when the door is in other than a closed position, or according to any other scheme.

In another aspect, a security system is capable of remote, selective deactivation of the automated garage door opening system, for example, cutting power to the system. In accordance with this aspect, a first switch remotely and selectively actuates the motor which powers the automated door to either open or close the door; and a second, remotely actuated switch effects selective interruption of the electrical power to the door motor to effectively lock (or unlock) the door by rendering the motor incapable (or capable) of responding to the appropriate RF signal transmission, which may be produced by the warning device, by a user, or by any other source. In accordance with various aspects of this embodiment, the second switch is an RF switch that may be inserted into an electrical outlet. The electric door motor is then plugged into the RF switch such that the second switch suitably enables or disables electrical power to the door motor in response to an RF signal.

In another embodiment, an abutment switch is capable of engaging with a vehicular windshield and thereby actuating the garage door motor to close the garage door when a vehicle is sufficiently inside the garage.

In one embodiment, the signaling sensor device is placed so that it will emit a signal when the door is closed. In another embodiment, the sensor is placed to emit a signal when the door is open. In a further embodiment, the sensor is placed to emit a signal when the door is partially open or ajar.

In a further embodiment, the signal generating device employs a transceiver to transmit the signal to the warning device. In one embodiment, the transceiver is battery powered and employs a timer which enables the transceiver to send a signal to the warning device for a predetermined amount of time so that battery life for the sensor device may be conserved. In an alternative embodiment, the warning device may be configured to transmit a signal back to the transceiver on the sensor device to indicate that the indicator on the warning device has been acknowledged and that the sensor device's transceiver can cease transmission of the warning signal. This acknowledgment signal may be in response to an operator moving the door back to the predetermined position, a separate signal from the warning device, or any other stimulus.

In a further exemplary embodiment, the sensor device comprises a "mercury type switch" that uses conductive liquid flow to open and close a circuit that produces an electrical signal indicative of the door's position. The mercury switch suitably senses the position of the door by detecting changes in the door's horizontal or vertical position relative to the door being either open or closed, as appropriate. Thus, depending upon where the sensor device is placed on the door (e.g. whether the device is placed closer or further away from the midpoint in the door's total trajectory), the mercury switch may detect the degree to which the door has moved from a vertical to a horizontal position, or vice versa. In one embodiment, the mercury switch has two circuit positions, circuit open and circuit closed, and each circuit position corresponds to a particular door position. In another embodiment, the mercury switch has a number of contacts corresponding to a number of circuits which open and/or close depending upon the angle of the door in the door jam, such as open, closed, or partially open, and each position effects the transmission of a different position signal to the transceiver. When the transceiver receives a position signal from the mercury switch, the transceiver then transmits a signal corresponding to the particular position signal received from the mercury switch to the remote warning device to indicate whether the door is fully open, partially open, or closed, depending upon the position that the warning device is pre-set or programmed to detect. The remote warning device then activates the appropriate indicator on, for example, the control panel of the programmable warning device.

Various embodiments of the instant security system employ transceivers for effecting wireless, real time transmissions, such as, for example, RF transmissions, in response to preprogrammed or real time conditions. The transceiver suitably sends a predetermined signal to actuate (or de-actuate) the remote warning device and thereby permits an operator to intervene by moving the door to the predetermined position. In one embodiment, a signal from the sensor device indicating that the door is in the predetermined or preprogramed position triggers the transceiver to transmit a signal, through RF for example, to the remote warning device. In another embodiment, the sensor device can transmit a remote signal to the warning device when the door attains a preprogramed position.

In accordance with another embodiment, the system can be programmed by means of a cycled or timed determination to change the criteria which actuates the warning device. Thus, the warning device may remain deactuated during early evening daylight hours in the summer, for example, but be timed to actuate the warning device if the door remains open after dark. This can be accomplished with a timer or a photovoltaic cell. Optionally, the timer also permits a user to program a specific time, or times, of the day at which the sensor device will monitor the status or condition of the door and will transmit a signal to the warning device if the garage door is in other than a closed position.

In a further embodiment, the security system of the instant invention employs at least one remote control panel having means for actuating and/or de-actuating the door, transceiver and/or other transmitter means for communicating with the door motor, the sensor device, and the door locking mechanism, and a warning indicator for indicating whether the door is in a predetermined position. Preferably, the remote control panel contains a programmable actuator for changing the door position criteria upon which the sensor and/or the warning device is activated (or deactivated). The means for actuating the door motor can include a switch or button which, when actuated, will either open the door if it is closed or close the door if it is open or allow movement to a predetermined position.

In one embodiment, the control panel means for indicating whether the door is in a predetermined position is a light. In another embodiment, the means for indicating whether the door is in a predetermined position is a means for emitting at least one audible alarm. The audible alarm can be at least one sound or tone which is emitted by, for example, a speaker. In another embodiment, the control panel has both a light and a means for sounding at least one tone and further has a switch for selectively actuating either the light, the means for sounding at least one tone, or both. In another embodiment, the control panel has an onboard power supply, which is preferably a battery, and a low power or low battery indicator light. In another embodiment, the control panel has means for locking (or unlocking) the door and means for indicating whether the door has been locked (or unlocked). Means for locking (or unlocking) the door can include, for example, an actuator means for transmitting a signal to a remote transceiver to interrupt (or reestablish) the electrical power to the door motor or otherwise disable (enable) or disengage (engage) the automated door opener. The actuator means for locking (unlocking) the door can include a switch or button which, when actuated, transmits a signal to remotely disengage (or engage) the automated door opener. The means for indicating whether the door has been locked (or unlocked) includes an indicator light.

In another embodiment, the warning device is a key ring style or car visor style remote transmitter or transceiver device having a switch or button to actuate the door motor and another switch or button to interrupt the power supply to the door motor. A key ring style or car visor style remote transmitter device, for example, suitably includes an indicator light that may be illuminated when the door is in other than the predetermined position. The light may be turned off when the door has been returned to the predetermined position so that a user who is driving away from the house or building can know that the door has been closed.

Other objects, features, and advantages of the present invention will become apparent to those skilled in the art from the following detailed description. It should be understood, however, that the detailed description and specific examples, while indicating exemplary embodiments of the present invention, are given for purposes of illustration and not of limitation. Many changes and modifications within the scope of the present invention may be made without departing from the spirit thereof, and various embodiments of the invention include such modifications.

BRIEF DESCRIPTION OF THE DRAWINGS

The above and further objects of the invention will become more readily apparent as the invention is more fully understood from the following detailed description with reference being made to the accompanying drawings in which like reference numerals represent like parts throughout and in which.

DETAILED DESCRIPTION OF EXEMPLARY EMBODIMENTS

Although for purposes of illustration the present invention is frequently described as pertaining to a security system for a garage door, it will be appreciated that many different embodiments could be formulated. For example, the systems and techniques described herein could be readily applied to home security systems, office security systems, industrial security systems, or the like. Moreover, the systems and techniques could be applied to garage doors, internal or external home or office doors, windows, chimneys, and other portals. No element described herein is necessary to the practice of the invention unless explicitly described as "essential" or "required".

Figure 1A:
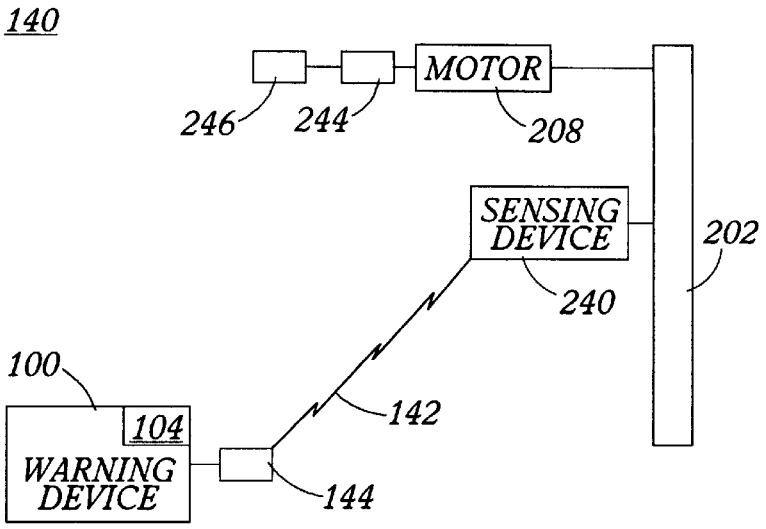
FIG. 1A is a block diagram of an exemplary security system.

FIG. 1A is a block diagram of an exemplary security system 140 in accordance with various aspects of the invention. With reference now to FIG. 1A, security system 140 suitably includes a sensing device 240 coupled to a door 202 to sense the position of door 202. Sensing device 240 suitably provides a digital, analog, electronic or other signal 142 via a transceiver 242 or other signal generator to a warning device 100, which may be configured to compare the position of door 202 to a pre-determined position stored within warning device 100. If the position of door 202 is not in a pre-determined position, warning device 100 suitably provides a visual, audible or other warning, such as a siren, alarm, or flashing light. In various embodiments, sensing device 240 and warning device 100 communicate via wireless transceivers 242 and 144, respectively.

Warning device 100 may be configured via a programmable control device (also referred to herein as an "actuator device") 104, which may include a microprocessor, microcontroller, programmable array logic device, or another equivalent device in communication with a digital memory. Various embodiments of control device 104 may also include a keypad, touchpad, digital computer interface, or other input device for receiving programming instructions from a user. These user instructions may include times that security system 140 is activated or deactivated, types or warnings that may be appropriate for particular times (e.g. flashing lights prior to 10 pm, sirens and lights after 10 pm), pre-determined positions for door 202 at various times (e.g. closed by 10 pm), sampling intervals for determining the position of door 202 (e.g. hourly, quarter hourly, every minute, continually, or the like), or any other configuration information. Control device 104 suitably accepts user instructions from the input device, stores the instructions in memory, and processes the instructions as appropriate and as described more fully below.

In various embodiments, an enhanced security measure is provided by switch 244, which is suitably configured to disable power or to otherwise shutdown the operation of door 202. As shown in FIG. 1A, switch 244 suitably receives a wireless command signal via transceiver 246 and provides a corresponding signal to a motor 208 coupled to door 202. In various embodiments, switch 244 is an electrical switch suitably positioned between motor 208 and an alternating current (A.C.) source such that power to the motor is suitably disabled upon receipt of an appropriate command signal at transceiver 246.

Figure 1B:
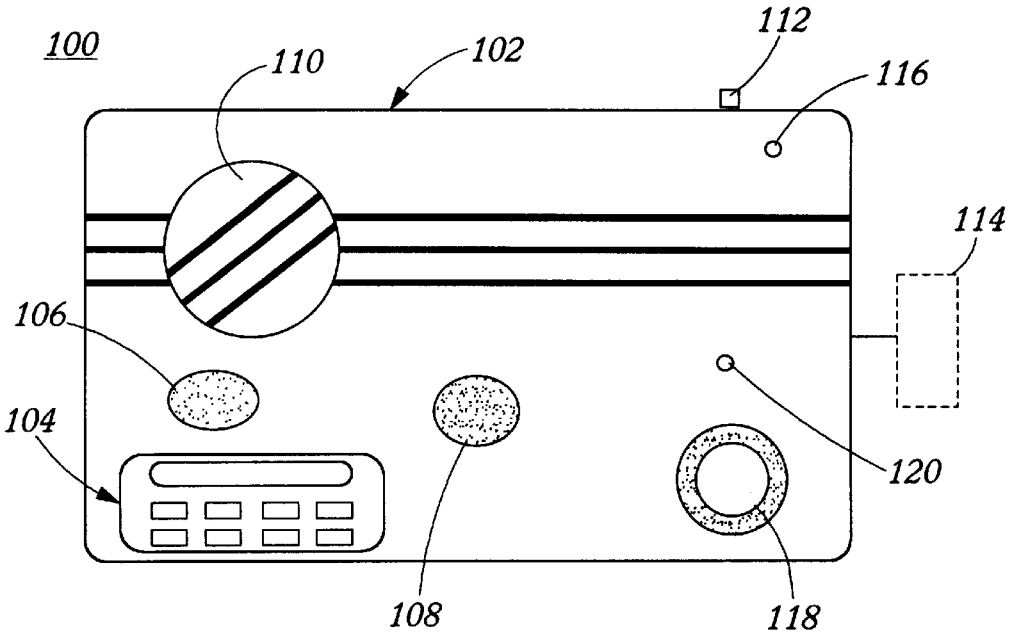
FIG. 1B is a perspective view illustrating an exemplary embodiment of the warning device of the instant invention.

FIG. 1B is a diagram of an exemplary warning device 100. With reference to FIG. 1B, various embodiments of warning device 100 suitably include a control panel 102 that houses a visual warning indicator 108, a speaker 110, a button or switch 106 for opening or closing door 202, an optional disabling button/switch 118 with an associated indicator light 120, and an optional battery power indicator light 116. Although not shown in FIG. 1B, various embodiments of warning device 100 will also include a power supply 114, a wireless transceiver 144, a micro-controller or other processor, a memory, and other associated electronics component. Optionally, the remote control panel 102 has a programmable actuator device 104 configured to change the door position criteria which triggers activation (or deactivation) of sensor device 240 (FIG. 2) and/or warning device 100. The programmable actuator means 104 may include a conventional timer such as a digital or analog clock, a timed circuit, or the like. The switch or button 106 are suitably configured such that, when actuated, button 106 opens or closes door 202 (FIG. 2), as appropriate. Alternatively, button 106 may be configured to allow the door 202 to move to a predetermined position, such as a slightly opened position that allows ventilation into a garage or other area.

Figure 2:
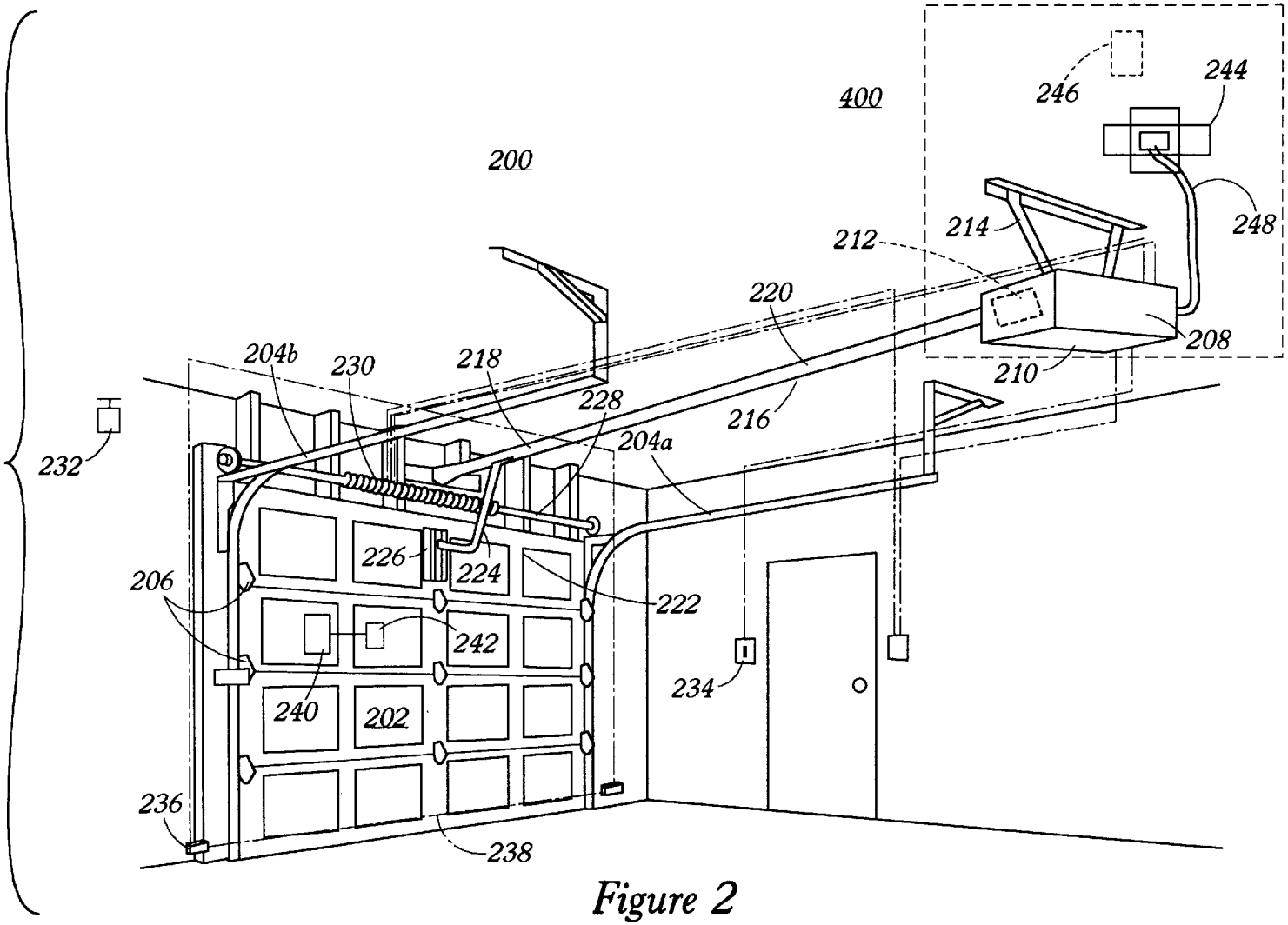
FIG. 2 is a perspective view illustrating a garage door opening system employing an exemplary embodiment of the security system of the instant invention.

In one embodiment, the control panel 102 element for indicating when door 202 is not in a predetermined position is a light 108. In various embodiments, indicator light 108 can be different colors depending upon the position of the door 202 (FIG. 2). For example, if door 202 is fully open, light 108 may be red; if door 202 is partially open, light 108 may be yellow; and if door 202 is closed, light 108 may be green. Of course, many different warning or indication schemes could be formulated, and all are within the ambit of the present invention.

In another embodiment, the control panel 102 element for indicating when door 202 is not in a predetermined position is siren, alarm or other audible sound played through, for example, speaker 110. The audible alarm may be at least one sound or tone emitted by, for example, speaker 110. In one embodiment, speaker 110 emits one particular tone when the door is in other than a closed position, a second tone when the door is fully opened, and a third tone when the door is partially open. Alternatively, speaker 110 periodically emits one "beep" when the door is in a closed position and emits two "beeps" when the door is in other than a closed position. In another embodiment, the control panel 102 has both a light 108 and an audio device 110 for sounding at least one tone. Control panel 102 may further have a switch 112 for selectively actuating either the light 108, the means for sounding at least one tone 110, or both. In an exemplary embodiment, the control panel 102 has an internal power supply 114 (such as a battery or a connection to an A.C. source) and a low power indicator light 116 that indicates when the power of a battery in power supply 114 is low. In another embodiment, the control panel has means for locking (or unlocking) the door and means for indicating whether the door has been locked (or unlocked), as described below in connection with FIG. 4. The means for locking (or unlocking) the door may include a switch or button 118 which, when actuated, transmits a signal to a remote device (described in greater detail below with reference to FIG. 2) which is triggered to disable or disengage the automated door opener. The indicator 120 for identifying whether the automated door has been locked (or unlocked) may be an indicator light, light emitting diode, digital display, sign or the like.

Figure 1C:
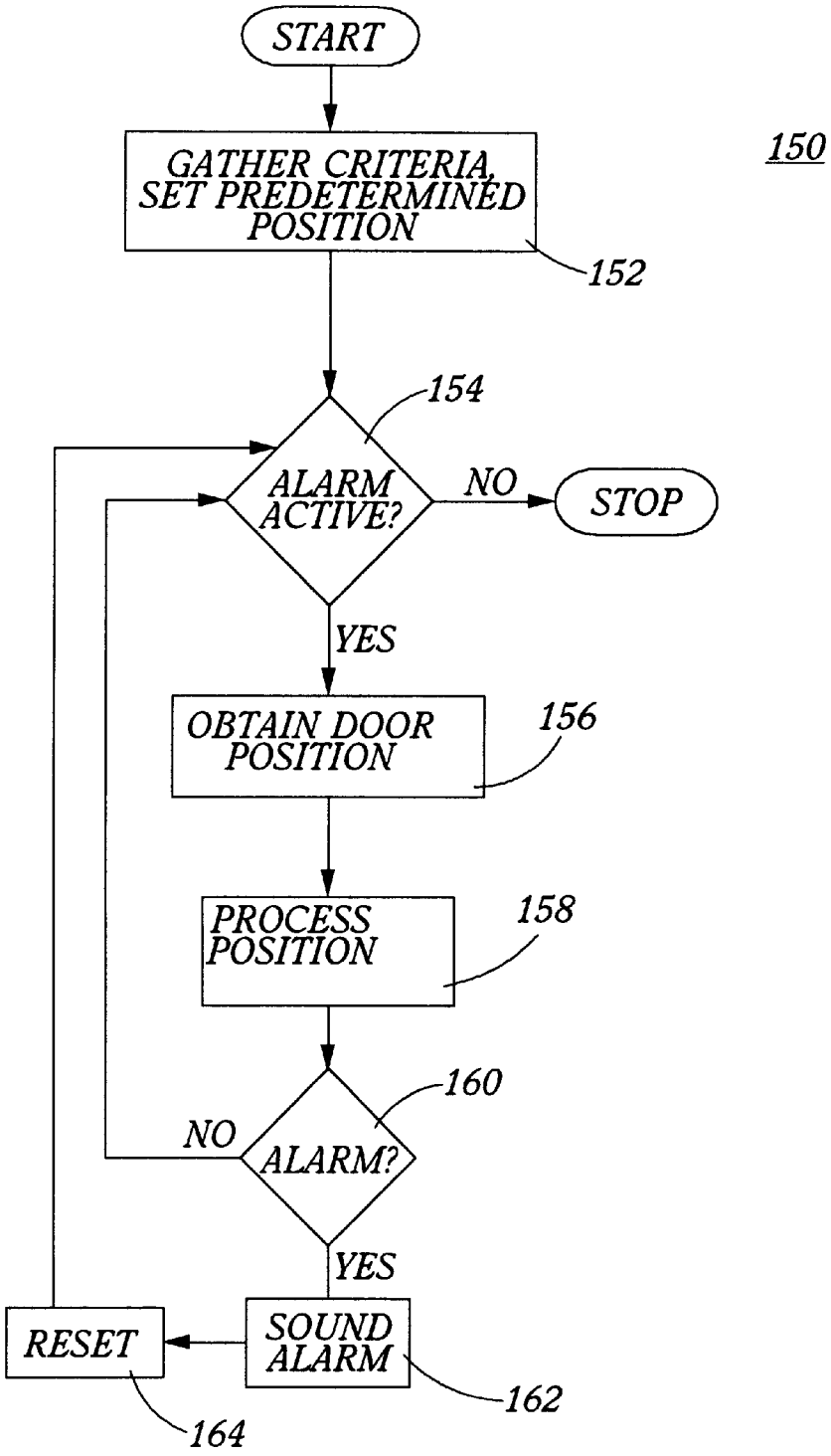
FIG. 1C is a flowchart of an exemplary process for operating a security system.

Security system 140 suitably executes an operating process 150 to secure door 202 and to provide alarms, as appropriate. Any processor, controller or other computing device such as the computing device present in control device 104 could be used to control operating process 150. In various embodiments, sensing device 240, warning device 100 and the various transceivers in security system 140 suitably include programmable or pre-programmed computing or control devices that inter-operate to effectuate control of security system 100. Although any number of processes could be used in various embodiments of security system 140, it will be appreciated that FIG. 1C is a flowchart of an exemplary process 150 for operating a security system 140. With reference now to FIG. 1C, an exemplary process 150 suitably includes gathering configuration or other input from a user (step 152), activating an alarm in response to the user input (step 154), determining a position of door 202 (step 156), processing information about the position of door 202 (step 158), and processing an alarm as appropriate in response to the position of door 202 (steps 160, 162, and 164). Gathering criteria for operating the alarm system may include, as appropriate, receiving user configuration data via control device 104, receiving inputs from a light or temperature sensor, or the like. In various embodiments, a user enters configuration data into a keypad, touchpad or other input device associated with control device 104. Configuration data may include hours of operation and/or one or more desired positions of door 202 during the hours of operation. Alternatively, the user may select a desired position for door 202 at a particular time, or in response to light or temperature conditions. In such embodiments, warning device 100 may accept inputs from photovoltaic cells, photodiodes, or other devices that are capable of sensing light such that warning device 100 is activated (or deactivated, as appropriate) in response to light conditions. In such embodiments, warning device 100 may be configured via control device 104 such that the alarm only sounds when door 202 is not in the pre-determined position during nighttime hours, for example, or such that the pre-determined position changes from night to day. Further, control device 104 or warning device 100 may accept inputs from a heat sensor such that the alarm is activated/deactivated or such that the predetermined position of the door changes according to changes in temperature. In these various embodiments, control device 104 may be programmed to raise door 202 slightly for ventilation purposes when the temperature exceeds a threshold level, for example, or to ensure that door 202 is closed when heating or air conditioning units are engaged. It will be appreciated that inputs to the security system 140 may be obtained from any source such as a wireless link, a link (such as a network link, a serial link or a parallel link) to a computer system, or the like, and may consider various factors such as time, date, temperature, humidity, light conditions, or the like.

After the user has configured security system 140, the alarm is activated as appropriate (step 154). The alarm may be activated in response to a time of activation, a temperature or heat sensor, or any other factor as described above. When the alarm is active, control device 104 suitably monitors the position of door 202 in accordance with the parameters and criteria input in step 152. When the alarm is not active, security system 140 suitably remains inactive and/or responsive to further configuration instructions (step 152). In an exemplary embodiment, the alarm is active during a certain period of time each day (such as from 10 pm until 7 am), or on certain dates that a user is away from home, or in response to temperature/heat criteria.

When the alarm is activated, control device 104 suitably obtains position information about door 202 (step 156). Sensing device 240 suitably obtains the position of door 202 through a mercury, gravity-based or other sensor and provides signal 142 to control device 104 via a wireless transceiver, as described elsewhere herein. Methods and techniques for obtaining information about door 202 at control device 104 vary from embodiment to embodiment. Control device 104 (or warning device 100) may query sensing device 240 at regular intervals, for example, to obtain a signal 142 indicating the current position of door 202. In other embodiments, control device 104 may query sensing device 240 at discrete time, or according to any other scheme. Alternatively, sensing device 240 provides position signal 142 continuously or in response to a timer associated with sensing device 240. In still other embodiments, sensing device 240 may be configured to provide position indication signals 142 when the position of the door changes, or according to a desired interval (such as every five minutes).

When control device 104 receives a position signal 142 from sensing device 240, the position signal may be processed as appropriate (step 158). Typically, a pre-determined position will be entered by a user or otherwise deduced from the information provided in step 152. For example, the pre-determined position may be "down" during the evening hours or "up" when the temperature exceeds ninety degrees, unless such time is after 10 p.m (in which case the pre-determined position may be "down").

Processing circuitry associated with control device 104 and/or warning device 100 suitably determines the desired, pre-determined position for door 202 under current circumstances. The processing circuitry then compares the predetermined position to the present position reported by sensing device 240 to determine if an alarm condition exists (step 160). An alarm condition may exist if the current position of the alarm does not match the pre-determined position, for example, thus triggering the flashing of lights and/or the playing of sirens or other audible alarms (step 162). In a further aspect, the particular alarm triggered by control device 104 may be configured according to the time of day or the condition (e.g. heat, temperature, time, etc.) that triggered the alarm. If an alarm is triggered during the day, for example, a flashing light may be sufficient for some embodiments, whereas an audible alarm may be more appropriate for an alarm triggered at night. In various embodiments, control device 104 may be configured to adjust the position of door 202 during alarm conditions (e.g to close door 202 if door 202 is open when the pre-determined state is "closed"). This functionality may be effected by coupling alarm circuitry in control device 104 to optional door actuation circuitry in warning device 100.

After an alarm has been triggered, the alarm may be reset (step 164) automatically (e.g. after an appropriate period of time) or manually by a user. In the latter case, the alarm may be reset by toggling the position of door 202, by actuating a reset button/switch (not shown) on control panel 102, or otherwise. After the alarm is reset, normal operation may continue as appropriate.

A exemplary door opening system 200 based upon a conventional garage door opener is shown in FIG. 2. Of course any door opening system could be used with the present invention, and the system shown in FIG. 2 is for illustrative purposes only. In the embodiment shown in FIG. 2, an automated door 202 is mounted on tracks 204*a* and 204*b* so that the door 202 can be moved vertically to a fully opened horizontal position that is above the garage floor. Often, door 202 will contain horizontal hinges 206 to facilitate the opening and closing movement. The door 202 is suitably raised and lowered by a reversible motor 208 housed in the motor housing 210 which may be mounted on the ceiling or in another appropriate location with bracket 214. The reversible motor 208 drives a chain 216 that is connected to a trolley 218, which rides a rail 220 and suitably includes a release cord 222. A hinged lever arm 224 may be attached to door 202 with a bracket 226. Thus, motor 208 effectively drives chain 216 to drive trolley 218 in a forward or reverse direction to raise or lower door 202. A shaft 228, rotatably mounted above the door 202, has a conventional counterweight spring 230 to counter balance the weight of the door 202.

Motor 208 may be activated to open or close door 202 by a remote transmitter 232, a by a hard wired wall switch 234, or another activation device. Typically, a receiving switch 212 suitably detects a radio signal from the remote transmitter 232, decodes the signal, and triggers the activation of the door opener motor 208, as appropriate. The remote transmitter 232 may be a key ring type remote transmitter, a car visor type remote transmitter, or the remote warning device 100 shown in FIG. 1. Various embodiments of remote transmitter 232 are capable of transmitting a signal to the receiving switch 212 and/or the RF switch 244 (described in greater detail below in conjunction with FIG. 4).

Various embodiments of system 200 suitably include a conventional obstruction sensor 236 which reverses the downward direction of the door 202 when a wireless signal 238 across the portal blocked by door 202 is interrupted. Sensor 236 suitably includes a beam 238 that provides obstruction detection by detecting the presence of an obstruction in the path of the door 202 if the door 202 is in motion. If beam 238 is obstructed or interrupted when motor 208 is lowering the door 202, then the sensor system 236 sends a signal which causes the motor 208 to reverse and return the door 202 to its fully opened position.

A programmable security system in accordance with various aspects of the present invention suitably includes a sensor device 240 for determining the position of door 202; a transceiver 242 for generating an appropriate signal; and a programmable, remote warning device 100 (FIG. 1) for indicating that the door is in other than a predetermined position. Sensor device 240 suitably includes a sensor for determining the door's position. The sensor which communicates electrically or otherwise with transceiver 242 to generate and transmit an appropriate signal to warning device 100 (FIG. 1). The transceiver 242 transmits a signal to warning device 100 (FIG. 1) via radio frequency (RF), infrared, ultrasonic, visible light or by any other wireless medium that may be available. The sensor device 240 may be placed or attached on the garage door frame (not shown), on the interior of garage door 202, or elsewhere as appropriate.

In various embodiments, sensor device 240 and transceiver 242 are housed in a single unit. In one embodiment, transceiver 242 is battery powered and employs a timer that enables transceiver 242 to send a signal to the warning device 100 (FIG. 1) for a predetermined amount of time so that battery life for the sensor device 240 may be conserved. That is, transceiver 242 is active to transmit a signal to warning device 100 for only a limited period of time, as indicated by the timer, so that the transceiver battery power is conserved. Alternatively, warning device 100 may be configured to transmit an acknowledgment signal back to the transceiver 242 on the sensor device 240 to reflect that warning device 100 (FIG. 1) has received the signal from sensor device 240. When transceiver 242 receives the acknowledgment signal from warning device 100, sensor device 240 may be configured to cease transmission of the warning signal. In still further embodiments, signals from sensing device 240 are polled by warning device 100 in accordance with user instructions, pre-determined intervals, or any other criteria. In such embodiments warning device 100 suitably transmits a position request signal to sensing device 240 when a position indication is desired. Such polling/position request signals may be sent hourly, quarterly hourly, every minute, every 10 seconds, or according to any other interval or schedule.

Figure 3:
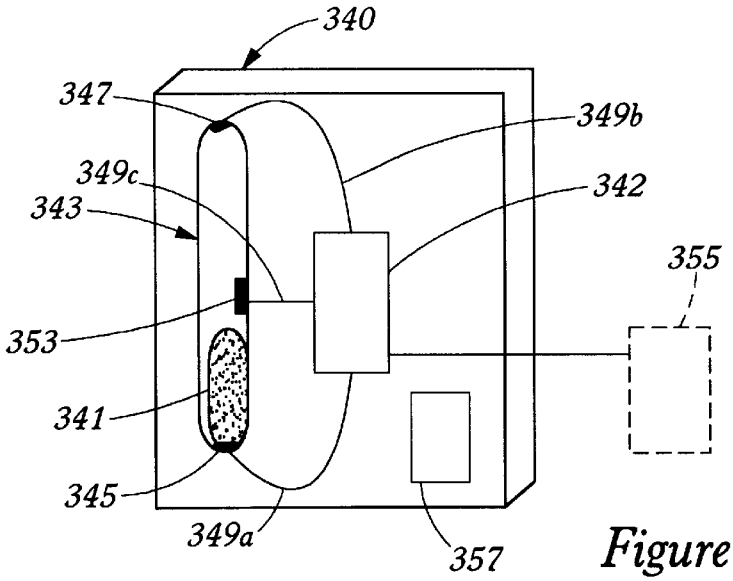
FIG. 3 is an orthographic view of an exemplary sensor switch structure.

Sensor device 240 may be any type of device or switch capable of sensing or determining the position of the door 202 along its trajectory on the rail 220. In accordance with various embodiments, sensor device 240 may be any conventional sensor device such as a mechanical, magnetic, infrared ("IR"), optical, photovoltaic, or motion sensor, or the like. In an exemplary embodiment, the sensor device 240 includes a mercury type switch 340, an example of which is illustrated in FIG. 3. In the embodiment shown, mercury switch 340 uses the flow of a conductive liquid 341 within a container 343 to open and close one or more circuits. Mercury switch 340 suitably senses the position of the door 202 (FIG. 2) in the opening by detecting changes in the position of the liquid 341 (which may be mercury or a similar substance) within container 343 due to gravity, which correspond to changes in the horizontal or vertical position of door 202. Changes in the door's position may be measured with respect to a fully opened position, a fully closed position, a midpoint position, or any other position of door 202. Thus, depending upon where the mercury switch 340 is placed on the door 202 (FIG. 2), that is, whether the mercury switch 340 is placed closer or further away from the midpoint in the door's total trajectory, the mercury switch 340 suitably detects the degree to which the door 202 (FIG. 2) has moved from a vertical to a horizontal position, or vice versa.

In one embodiment, mercury switch 340 has two circuit positions, corresponding to an open circuit and a circuit closed, with each circuit position corresponding to a particular door position (e.g. door open or door closed). With continued reference to FIG. 3, for example, when the liquid 341 covers contact 345 alone (e.g. corresponding to a substantially closed door), the circuit established by contact 345, contact 347, contact leads 349*a* and 349*b*, and transceiver 342 is open. Accordingly, transceiver 342 may transmits a signal to warning device 100 (FIG. 1) that the door 202 (FIG. 2) is fully closed. Alternatively, when the liquid flow 341 covers contact 345 and 347 simultaneously, the circuit established by contact 345, contact 347, contact leads 349*a* and 349*b*, and transceiver 342 is closed, and transceiver 342 transmits a signal to warning device 100 (FIG. 1) that the door 202 (FIG. 2) is open. Of course, other equivalent embodiments of open and closed circuits or different signaling schemes could be formulated.

In another embodiment, the mercury switch 340 suitably includes a number of contacts corresponding to a number of circuits which open and/or close depending upon the angle of the door in the door jam, such as open, closed, or partially open, and each position effects the transmission of a different position signal to the transceiver. For example, when the liquid flow 341 covers contact 345 and contact 353, the circuit established by contact 345, contact 353, contact leads 349*a* and 349*c*, and transceiver 342 is closed, and transceiver 342 transmits a signal to warning device 100 (FIG. 1) that the door 202 (FIG. 2) is partially open.

Transceiver 342 may be activated by, for example, a signal from warning device 100, a signal from timer 357, an electrical signal from sensor 340, or any other technique. In various embodiments, transceiver 342 suitably receives a position signal from mercury switch 340. After receiving the position reading from sensor 340, transceiver 342 transmits a signal corresponding to the particular position signal received from sensor device 340 to the remote warning device 100 (FIG. 1) to indicate whether the door 202 (FIG. 2) is fully open, partially open, or closed, as appropriate. Of course the particular signals sent depend upon, for example, the position or positions that the warning device 100 (FIG. 1) is pre-set or programmed to detect and indicate. Signaling may be according to any protocol or scheme such as an infrared or RF signaling scheme. The transceiver 342 may powered by an onboard power supply 355 such as a battery. In an exemplary embodiment, transceiver 342 also employs a timer 357 to enable the transceiver 342 to send a signal to the warning device 100 (FIG. 1) for a predetermined amount of time so that battery life for the sensor device 340 may be conserved. As discussed above, warning device 100 (FIG. 1) suitably receives the signal from sensor device 240, processes the pre-programmed instructions as appropriate, and activates the appropriate indicator on the control panel 102 (FIG. 1) of the warning device 100 (FIG. 1).

Figure 4:
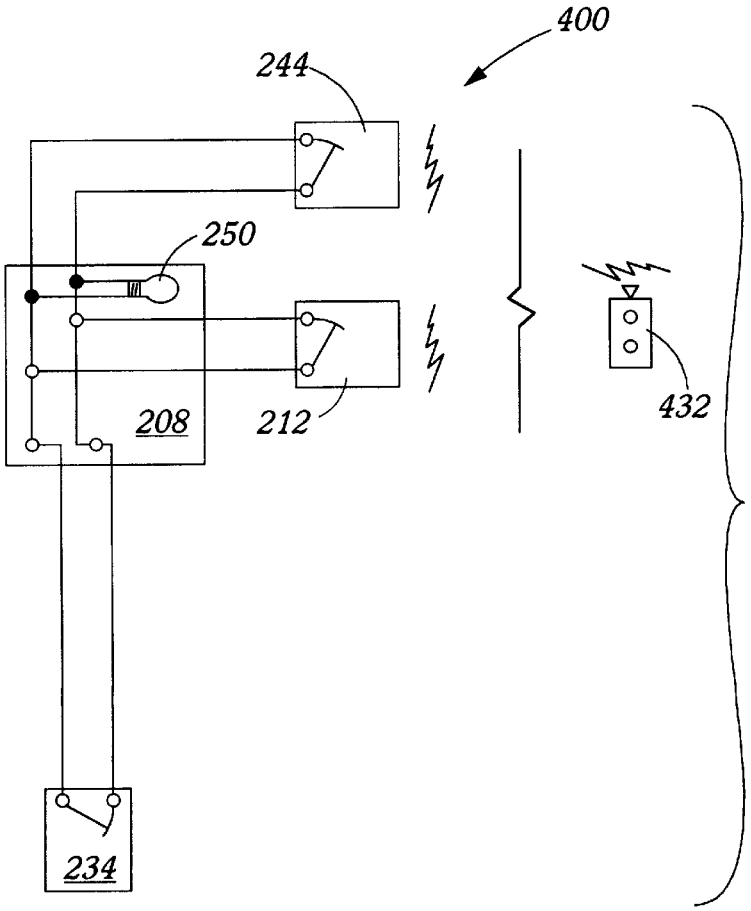
FIG. 4 is a schematic electrical circuit diagram illustrating an exemplary door locking mechanism in accordance with the system of the instant invention.

Turning now to FIG. 4, a schematic electrical circuit diagram illustrates a door locking mechanism 400 in accordance with various aspects of the security system 140. Remote transmitter receiving switch 212 or a hard wired wall switch 234 suitably communicate with motor 408, which is energized by an external source not shown in FIG. 4. An RF switch 244 likewise communicates with motor 408 to enable or disable the operation of motor 408. In various embodiments, remote transceiver 432 (which may be carried by a person or in a vehicle, for example) is capable of transmitting signals to both transmitter receiving switch 412 and RF switch 444. To effect transmission to both switches, transceiver 432 may include two separate buttons corresponding to "open/close door" (e.g. activation of switch 212) and "lock" (corresponding to activation of switch 244). When RF switch 444 is closed, then, the automated garage door system is suitably activated and door 202 is unlocked. When RF switch 444 receives a signal from remote transceiver 432 that opens the RF switch 444, the circuit is broken, the automated garage door mechanism is deactivated, and the door 202 is effectively locked. Further operation of switch 212 will not close the circuit and effect operation of the door when switch 244 is open (i.e. when the lock is engaged). As discussed above, In various embodiments, the present security system further includes a device for locking or unlocking the automated garage door by remotely and selectively deactivating (or activating) the automated garage door opening system. Such a device may include, for example, disrupting electrical power to the door motor 208 by means of a remote RF switch 244 having a transceiver 246 as discussed above. Transceiver 246 suitably transmits and/or receives signals to or from remote sources, such as, for example, warning device 100 (FIG. 1), a key ring type remote transceiver 432, or a car visor type remote transceiver 432. With momentary reference again to FIG. 2, remote RF switch 244 may be inserted into an electrical outlet, and the door motor 208 may be connected to the RF switch 244 by door motor plug 248. In such embodiments transceiver 246 of the RF switch 244 disrupts the flow of electricity to the door motor 208 upon receipt of a signal from an appropriate remote unit to disrupt the flow of electricity to the door motor 208. Since motor 208 will not typically operate without a source of electric power, RF switch 244 effectively disengages or locks the automated door by rendering the transmitter receiving switch 212 incapable of responding to the appropriate RF signal transmission. Conversely, RF switch 244 may re-establish the flow of electricity to both the transmitter receiving switch 212 and the door motor 208 to effectively re-engages or unlocks the automated door, as appropriate. In various embodiments, the RF switch 244 includes a light 250 to indicate whether the RF switch 244 is receiving power from the building's electrical system.

Figure 5:
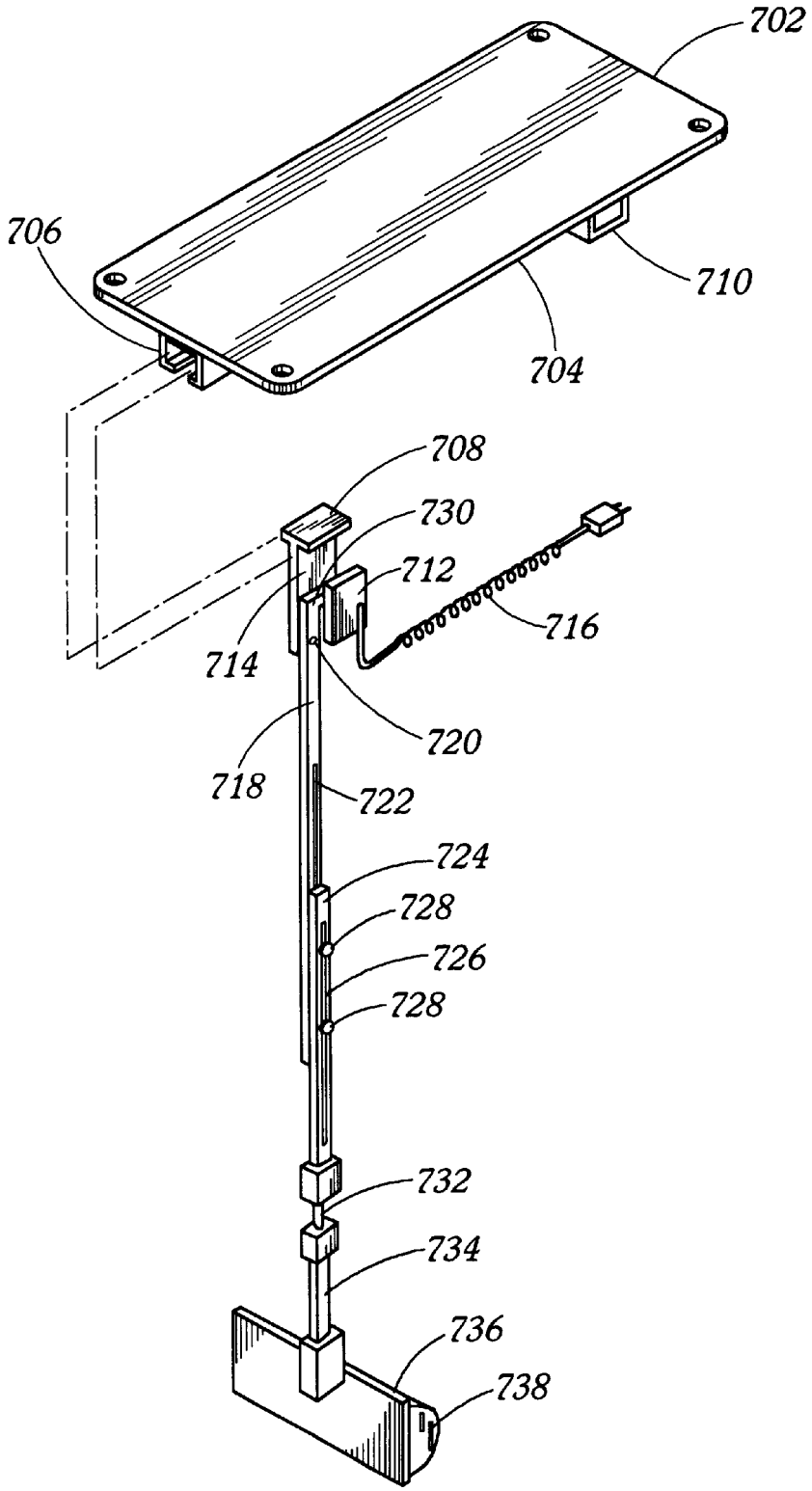
FIG. 5 is an isometric illustration in an exploded view of an exemplary windshield striker utilized by the system of the instant invention.

Turning now to FIG. 5, there is shown an additional component of an optional embodiment that includes a windshield impact switch structure 700 to effect closure of the garage door and actuation of the associated garage door motor upon contact of the switch structure with a vehicular windshield. In accordance with the invention, a mounting plate 702 is provided for mounting a windshield impact switch structure 700 to a ceiling structure. The mounting plate 702 has a first surface 704, having a guide track 706 incorporated or affixed longitudinally along the mounting plate 702. The guide track 706 is arranged to receive both a follower flange 708 slidably therewithin and an electrical socket 710, which is in electrical communication with and actuates door motor 208 to effect closure of door 202. A striker switch member 712 is mounted to a follower flange support flange 714 projecting orthogonally and downwardly below the follower flange 708, wherein the striker switch member 712 has an electrical power cord 716 for electrical communication with the electrical socket 710. A pivot arm 718 is pivotally mounted about a pivot arm axle 720 to the follower flange support flange 714. The pivot arm 718 has a pivot arm slot 722 to slidably and vertically accommodate in an adjustable manner a striker arm 724 having a striker arm slot 726 utilizing fasteners 728 to secure the striker arm 724 and the pivot arm 718 together in a longitudinally aligned relationship. A pivot arm actuator projection 730 mounted to an upper end of the pivot arm 718 is arranged for engagement with the striker switch member 712. The striker arm 718 includes a frangible link 732 at a lower end thereof mounting a contact head arm 734, wherein the frangible link 732 is ruptured upon sudden impact with a vehicle windshield to prevent unnecessary damage to the vehicle. The contact head arm 734 includes a contact head plate 736 mounted to a lower end of the contact head arm 734 that is arranged generally parallel to the pivot arm 718 and the striker arm 724. It should be noted that frangible link 732, contact arm 734, the pivot arm 718, and striker arm 724 are arranged in a longitudinally aligned relationship as indicated in FIG. 7. An abutment cushion 738 enclosing a compressible gel (not shown) is mounted to a forward surface of the contact head plate 736 to accommodate impact with a vehicular windshield and to avoid marring the windshield.

Although the present invention has been described with reference to preferred embodiments, numerous modifications and variations can be made and the result still will come within the scope of the invention. No limitation with respect to the specific embodiments disclosed herein is intended nor should any be inferred.

What is claimed is:

1. A security system for determining if an automated door is in a pre-determined position, the security system comprising:

a sensor configured to determine a position of the automated door;

a signal generator in communication with said sensor and configured to provide a signal indicative of the position of the automated door;

a warning device configured to receive the signal; and processing circuitry associated with the warning device for comparing the pre-determined position of the automated door with the position of the automated door as indicated by the signal;

wherein said warning device provides a warning only when the position of the automated door differs from the pre-determined position of the automated door as determined by the processing circuitry.

2. The security system of claim 1 further comprising an actuator in communication with said warning device, wherein said actuator is operable to alter said pre-determined position based upon an external condition.

3. The security system of claim 2 wherein said external condition is supplied by one of the group consisting of: a control device, a photovoltaic cell, a clock; a timer; and a heat sensor.

4. The security system of claim 1 wherein said signal comprises a wireless signal.

5. The security system of claim 2 wherein said signal comprises a radio frequency (RF) signal.

6. The security system of claim 1 wherein said warning device further comprises a programmable actuator configured to accept user instructions and operable to change said pre-determined position in response to said user instructions.

7. The security system of claim 3 wherein said warning device further comprises a programmable actuator configured to accept user instructions and operable to change said pre-determined position in response to said user instructions.

8. The security system of claim 5 wherein said warning device comprises an indicator light configured to provide said warning.

9. The security system of claim 5 wherein said warning device comprises an audio speaker configured to provide said warning.

10. The security system of claim 1 further comprising a switch configured to receive an actuation signal and to disable said door as a function of said actuation signal.

11. The security system of claim 8 wherein said warning device is configured to produce said actuation signal in response to said warning.

12. The security system of claim 10 wherein a user produces said actuation signal.

13. The security system of claim 1 further comprising an abutment switch configured to produce an abutment signal in response to an engagement with a vehicle, wherein said abutment signal is operable to change said position of said door.

14. The security system of claim 1 wherein said signal generator comprises a transceiver powered by a battery and configured to transmit said signal.

15. The security system of claim 14 wherein said signal generator further comprises a timer coupled to said transceiver and configured to allow transmission of said signal for a pre-determined period of time and to disallow transmission of said signal after said pre-determined period of time.

16. The security system of claim 14 wherein said warning device is further configured to transmit an acknowledgment signal to said transceiver, and wherein said signal generator is operable to halt transmission of said signal upon receipt of said acknowledgment signal.

17. The security system of claim 1 wherein said sensor comprises a mercury switch coupled to an electrical circuit, wherein said electrical circuit produces a first output when said door is in a first position and wherein said electrical circuit produces a second output when said door is in a second position.

18. A security system for an automated door, the security system comprising:

means for sensing a position of said door;

means, in communication with said sensing means, for generating a signal indicative of said position of said door;

means for comparing said position of said door as indicated by the signal to a pre-determined position of said door to determine if said door is in a desired position; and means for producing a warning only when said position of said door differs from said desired position.

19. The security system of claim 18 wherein said signal comprises a wireless signal.

20. The security system of claim 19 wherein said signal comprises a radio frequency (RF) signal.

21. The security system of claim 18 wherein said producing means further comprises a means for programming said producing means, wherein said programming means is configured to accept user instructions and is operable to change the criteria affecting said warning in response to said user instructions.

22. The security system of claim 18 wherein said warning device further comprises a programmable actuator is configured to accept user instructions and operable to change the criteria affecting said warning in response to said user instructions.

23. A method of improving the security of an automated door, the method comprising:

selecting a pre-determined position of the automated door;

sensing a position of the automated door;

transmitting a signal indicative of the position of the automated door to a warning device;

comparing the position of the automated door as indicated by the signal with the pre-determined position of the automated door using processing circuitry associated with the warning device; and generating a warning only when the position of the automated door differs from the pre-determined position of the automated door as determined by the processing circuitry.

24. The method of claim 23 wherein said processing step comprises the step of obtaining said pre-determined position from a user.

25. The method of claim 23 further comprising programming said warning device prior to said sensing step to obtain warning criteria.

26. The method of claim 23 wherein said warning criteria comprises a time of activation.

27. The method of claim 23 wherein said warning criteria comprises said pre-determined position.

28. The method of claim 23 wherein said processing step comprises processing said warning criteria in conjunction with said signal.

29. The method of claim 26 further comprising the step of de-activating said warning after said processing step when said door arrives at said pre-determined position.

* * * * *